US006398434B1

(12) United States Patent
Corrigan, Jr.

(10) Patent No.: US 6,398,434 B1
(45) Date of Patent: Jun. 4, 2002

(54) SHAFT ASSEMBLY FOR APPLYING AN ADJUSTABLE LOAD TO A THERMAL PRINT HEAD

(76) Inventor: Richard W. Corrigan, Jr., 4 Victoria La., Hawthorne Woods, IL (US) 60047

( * ) Notice: Subject to any disclaimer, the term of this patent is extended or adjusted under 35 U.S.C. 154(b) by 0 days.

(21) Appl. No.: 09/677,568

(22) Filed: Oct. 2, 2000

(51) Int. Cl.[7] ..... B41J 2/315

(52) U.S. Cl. ..... 400/120.17; 400/120.16; 400/59; 347/197; 347/198

(58) Field of Search ..... 400/120.17, 120.16, 400/55, 56, 57, 59; 347/197, 198, 8

(56) References Cited

U.S. PATENT DOCUMENTS

| | | | | |
|---|---|---|---|---|
| 1,838,432 | A | | 12/1931 | Mitchell |
| 2,128,776 | A | | 8/1938 | Howell |
| 2,249,150 | A | | 7/1941 | Magrath |
| 2,895,578 | A | | 7/1959 | Winchell |
| 3,093,332 | A | | 6/1963 | Jackson |
| 3,157,258 | A | | 11/1964 | Cronholm |
| 3,157,406 | A | | 11/1964 | Smith, Jr. et al. |
| 3,242,696 | A | | 3/1966 | Kaplan |
| 3,285,528 | A | | 11/1966 | Beindorf |
| 3,375,995 | A | | 4/1968 | Roman |
| 3,395,553 | A | | 8/1968 | Stout |
| 3,405,791 | A | | 10/1968 | Kaplan |
| 3,411,684 | A | | 11/1968 | Tison et al. |
| 3,482,794 | A | | 12/1969 | Beardsley |
| 3,832,866 | A | | 9/1974 | Thomson |
| 4,058,192 | A | | 11/1977 | Haigh |
| 4,090,785 | A | | 5/1978 | Weninger |
| 4,109,770 | A | | 8/1978 | Perles |
| 4,273,299 | A | | 6/1981 | Ness |
| 4,323,202 | A | | 4/1982 | Laverty |
| 4,327,874 | A | | 5/1982 | Bruno |
| 4,527,683 | A | | 7/1985 | Mathews |
| 4,682,625 | A | | 7/1987 | Christopher |
| 5,062,722 | A | * | 11/1991 | Shiozaki et al. ..... 226/143 |
| 5,092,440 | A | | 3/1992 | Nakano |
| 5,219,234 | A | * | 6/1993 | Sakai ..... 358/296 |
| 5,297,750 | A | | 3/1994 | Hunt |
| 5,492,280 | A | | 2/1996 | Corres et al. |
| 5,570,564 | A | | 11/1996 | Moore et al. |
| 5,620,372 | A | | 4/1997 | Takada et al. |
| 5,626,309 | A | | 5/1997 | Morgan |
| 5,638,106 | A | * | 6/1997 | Nierescher ..... 347/198 |
| 5,825,392 | A | * | 10/1998 | Mochizuki ..... 347/197 |
| 5,947,409 | A | | 9/1999 | Corrigan, Jr. |

FOREIGN PATENT DOCUMENTS

| | | |
|---|---|---|
| CA | 533299 | 11/1956 |
| EP | 463248 | 2/1992 |
| EP | 479544 | 8/1992 |
| JP | 5106641 | 4/1993 |
| JP | 5164140 | 6/1993 |

* cited by examiner

*Primary Examiner*—Andrew H. Hirshfeld
*Assistant Examiner*—Kevin D. Williams
(74) *Attorney, Agent, or Firm*—Thomas J. Donovan; Barnes & Thornburg

(57) ABSTRACT

A shaft assembly for a thermal printer system for applying loads in an adjustable manner along the length of a thermal print head of the thermal printer system. The shaft assembly includes a shaft, and a plurality of cam mechanisms rotatably mounted on the shaft and adapted to apply respective loads to the thermal print head at respective locations along the length of the thermal print head. Each cam mechanism is rotationally coupled with an adjacent cam mechanism, and is adapted to be rotated from a non-load-applying position to load-applying position and from the load-applying position to subsequent load applying positions. Each cam mechanism is adapted to apply a respective load to structure associated with the thermal print head when the cam mechanism is in any of its load-applying positions. Each cam mechanism engages the adjacent cam mechanism as the cam mechanism rotates from its load-applying position to its first subsequent load-applying position to cause the adjacent cam mechanism to rotate from its non-load applying position to its load-applying position and to cause the adjacent cam mechanism to apply a respective load of the adjacent cam mechanism. The cam mechanisms may have any suitable profiles and may be rotationally coupled together in any suitable manner.

30 Claims, 14 Drawing Sheets

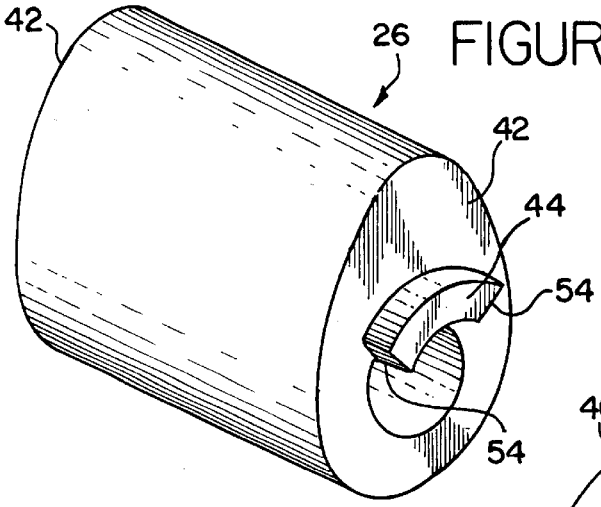
FIGURE 2
FIGURE 3
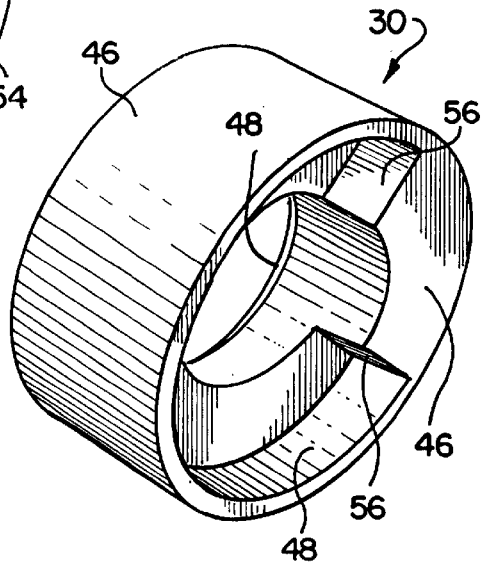
FIGURE 4(a)
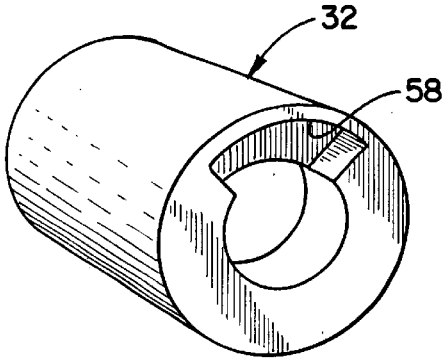
FIGURE 4(b)
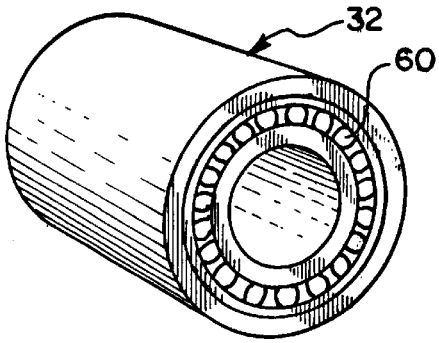

SHAFT ASSEMBLY FOR APPLYING AN ADJUSTABLE LOAD TO A THERMAL PRINT HEAD

TECHNICAL FIELD

The present invention relates to a shaft assembly for use with mechanisms or systems for applying mechanical load along the length of a thermal print head of a thermal printing system.

BACKGROUND

Within the broader category of electronic printer products, several different marking technologies have been employed to create and fix images to flexible print media such as paper, film and the like. Three contemporary technologies that are frequently used include xerographic, ink-jet and thermal printing. As is true for any of these technologies, thermal printing requires the implementation of hardware specific to its technology in order to accomplish the task of the thermal printing process.

A fundamental piece of hardware specific to thermal printing technology is the thermal print head. A thermal print head typically is in the form of a printed circuit board, incorporating several very small resistive heating elements positioned in a uniformly close spaced linear array, altogether comprising a print line which resides along or near one edge. The circuit board may be bonded to an aluminum support block to increase its structure rigidity.

During normal printer operation, the print head ordinarily is positioned so that the print line tends toward tangential contact with the outer cylindrical surface of an opposing platen roll and may be pivoted away from the platen roll for printer set-up or servicing. A spring load is typically applied to the print head to compliantly bias the print line in a direction normal to the platen roll surface. Media typically supplied by a spool is held in pressure contact, sandwiched between the print line and platen roll, while the platen roll is rotationally driven and print line resistive heating elements are selectively activated, in order to produce the desired two dimensional image. The area of pressure contact developed by the print line forcibly acting through the media and on to the platen roll is often referred to as the print nip.

Compressive stress within the print nip must be adequate to produce intimate contact between the print line resistive heating elements and media and thus guarantee thermal energy transfer for proper image formation, otherwise areas void of image may result. Conversely, excessive compressive stress within the print nip can cause increased abrasive wear on the thermal print head, resulting in premature print head degradation and diminished service life.

In certain types of thermal printers, it is desirable to have the capability to process a variety of different media sizes and therefore vary widths of media, all positionally registered from one end of the print head. As the width of the media being printed varies so does the effective area of the print nip. To maintain an optimum level of compressive stress, the print head load should generally vary with the area over which the load is distributed. Also, the load is distributed over the region of the print head under which the media resides, to prevent uneven contact stress from one end of the print nip to the other.

One prior art mechanism for applying a spring load to a thermal print head uses a linear plunger device incorporating a compression spring and adjustment nut. The adjustment nut can be rotated to vary the deflection of the compression spring and thereby change the plunger load against the print head. One or more of these linear plunger devices may be positioned to selectively engage a print head at a range of positions along its length. One drawback to this prior art mechanism is that for any particular width media and subsequent print nip area, there is no established print head load or position of load predetermined by engineering design. An individual setting up the machine typically must guess at load settings and position of the linear plunger devices, then run the printer to determine if print quality is acceptable. This process is iterative by nature, can take considerable time to achieve acceptable print quality, and can result in the waste of a substantial quantity of print media. Also, the linear plunger devices occupy a rather large space and are cumbersome to move in order to raise the print head for printer set-up or servicing.

Accordingly, it is an object of the present invention to provide a shaft assembly for a thermal printer system that enables the thermal print head to readily accommodate media of different widths.

It is a further object of the present invention to provide such a shaft assembly that is adapted to adjustably apply loads along the length of the thermal print head of the thermal printer system to accommodate the desired width of media.

It is a further object of the present invention to provide such a shaft assembly that includes a shaft and a plurality of cam mechanisms mounted thereto, each cam mechanism adapted to be rotated to apply a respective load to structure associated with the thermal print head to increase the load applied to the thermal print head along the length of the thermal print head to facilitate accommodation of wider media.

It is a still further object of the present invention to provide such a shaft assembly wherein the cam mechanisms are rotatably coupled to each other such that rotation of the shaft a predetermined amount causes one cam mechanism to rotate to a load-applying position, and further incremental rotations of the shaft causes additional cam mechanisms to rotate to their respective load-applying positions to thereby increase the load applied to the structure associated with the thermal print head and thereby facilitate accommodation of wider media.

SUMMARY OF INVENTION

In accordance with these and other objects, the present invention is directed to a shaft assembly for a thermal printer system for adjustably applying loads along the length of a thermal print head of the thermal printer system. The shaft assembly includes a shaft, and a plurality of cam mechanisms rotatably mounted on the shaft and adapted to apply respective loads to the thermal print head at respective locations along the length of the thermal print head. Each cam mechanism is rotationally coupled with an adjacent cam mechanism, and is rotatable from a non-load-applying position to a load-applying position and from the load-applying position to subsequent load-applying positions. Each cam mechanism is adapted to apply a respective load to structure associated with the thermal print head at a respective location of the structure when the cam mechanism is in its load-applying position and when the cam mechanism is in any of its subsequent load-applying positions. Each cam mechanism engages the adjacent cam mechanism as the cam mechanism rotates from its load-applying position to a first of its subsequent load-applying positions to cause the adjacent cam mechanism to rotate from the non-load applying position of the adjacent cam mechanism to the load-applying position of the adjacent cam mechanism. The cam mechanisms desirably are rotationally coupled, such that each incremental rotation of the shaft in a first or loading direction causes an additional cam mechanism to rotate from its non-load applying position to its load-applying position. The plurality of cam mechanisms may include any suitable number of cam mechanisms.

The cam mechanisms desirably all have the same construction, including any suitable cam profile. In a preferred embodiment, for example, each cam mechanism comprises a single lobe profile; and the degree of rotation of each cam mechanism from its non-load-applying position to its load-apply position is 180° and the degree of rotation from its load-applying position to subsequent load-applying positions is a multiple 360°. In accordance with an alternative embodiment, each cam mechanism may instead comprise a double lobe profile; and the degree of rotation of each cam mechanism from its non-load-applying position to its load-applying position is 90° and the degree of rotation from its load-apply position to subsequent load-apply positions is a multiple of 180°. In accordance with further alternative embodiments, the cam mechanisms may have other suitable profiles.

The cam mechanisms may be rotationally coupled together in a generally side-by-side manner in any suitable manner. For example, in accordance with a preferred embodiment, the shaft assembly may include a plurality of coupling members for coupling together the cam mechanisms, preferably with each coupling member coupling together a respective pair of cam mechanisms. Desirably, each cam mechanism includes a pair of end faces, and a nub on each end face, and each coupling member defines a pair of slots, each slot receiving one of the nubs of a respective cam mechanism. Desirably, the nubs and slots are arcuate, and the arc lengths of the nub and slots depend on the profile configuration of the cam mechanisms. If desired, the cam mechanisms may instead be rotationally coupled directly to each other in accordance with alternative embodiments of the invention.

The end cam mechanism may be rotated manually or in any suitable mechanical or electronic manner to cause rotation of the cam mechanisms. In a preferred embodiment, for example, the shaft assembly includes a drive hub rotationally coupled with one of the end cam mechanisms and a one-way roller clutch bearing associated with the drive hub so that rotation of the shaft in the first direction rotates the end cam mechanism to the load-applying position.

In a preferred embodiment, the shaft assembly also includes an unloading drive hub rotationally coupled with the other end cam mechanisms, and an other one-way roller clutch bearing for causing rotation of the cam mechanisms to non-load applying positions, preferably one at a time in response to rotation of the shaft in a second or unloading direction. The shaft assembly preferably includes a drive assembly that includes the unloading drive hub and a gear assembly for rotating the unloading drive hub in the first direction as the shaft rotates in the second direction. The gear assembly may include a drive hub gear associated with the unloading drive hub and a gear clutch disposed about the shaft, and a pair of idler gears which cause the drive hub to rotate in the first direction when the shaft is rotated in the second direction. The gear clutch desirably also includes a one-way roller clutch bearing oriented in a direction opposition the orientation of the roller clutch bearing associated with the drive hub.

Accordingly, in a preferred embodiment, the rotation of the shaft in the first direction causes driving load engagement of the one-way roller clutch bearing associated with the drive hub and therefore rotates the drive hub in the first or loading direction while the second one-way roller clutch bearing and its associated gear clutch are free from driving load engagement. The drive hub being rotationally coupled to the end cam mechanism in turn causes rotation of that adjacent cam mechanism in the first direction. Rotation of the shaft in second or unloading direction causes driving load engagement of the other one-way roller clutch bearing associated with the gear clutch and therefore rotates the gear clutch in the first direction while the drive hub and its associated one way roller clutch bearing are free from driving load engagement. The unloading drive hub is rotationally coupled to the other end cam mechanism and, because of the gear assembly, causes rotation of that other end cam mechanism in the first direction when the shaft is rotated in the second direction.

Accordingly, the present invention in accordance with a preferred embodiment provides a shaft assembly for a thermal printer system readily adapted to produce an appropriate predetermined force, properly distributed along the length of the print head, for the desired width media. A first turn or rotation of the shaft produces a predetermined load, appropriate for narrow width media, positioned adjacent the first end of the print head. Subsequent rotations of the knob in the same direction produce additional loading of the print head progressing from the first and toward the second end by rotating and engaging cams one by one, to accommodate increasingly wider media. Additionally, desirably, rotation of the shaft in the opposite direction disengages the loading of the print head toward the first end by rotating and engaging the cams one by one in a reverse direction. Thus, in accordance with a preferred embodiment, the printer can be set-up to process different width media very quickly and without waste of media.

BRIEF DESCRIPTION OF DRAWINGS

The present invention and the advantages thereof will become more apparent upon consideration of the following detailed description when taken in conjunction with the accompanying drawings.

FIG. 1(*b*) is a perspective view of the shaft assembly and other components of FIG. 1(*a*) with the spool removed, illustrating one of the cam mechanisms rotated to an engaged or load-applying position;

FIG. 1(*c*) is a perspective view of the shaft assembly and other components of FIG. 1(*a*) with the spool removed, illustrating two of the cam mechanisms rotated to their load-applying positions;

FIG. 1(*d*) is a perspective view of the shaft assembly and other components of FIG. 1(*a*) with the spool removed, illustrating three of the cam mechanisms rotated to their load-applying positions;

FIG. 1(*e*) is a perspective view of the shaft assembly and other components of FIG. 1(*a*) with the spool removed, illustrating all of the cam mechanisms rotated to their load-applying positions;

FIG. 2 is a perspective view of one of the cam mechanisms of FIGS. 1(*a*)–1(*e*);

FIG. 3 is a perspective view of one of the coupling collars of FIGS. 1(*a*)–1(*e*);

FIG. 4(*a*) is a perspective view of the drive hub of the shaft assembly of FIGS. 1(*a*)–1(*e*).

FIG. 4(*b*) is a perspective view taken from the other side of the drive hub of FIG. 4(*a*), illustrating a one way roller clutch bearing housed within the drive hub;

FIG. 8(*b*) is an other side view of the cam mechanism of FIG. 8(*b*);

FIG. 9(*b*) is a perspective view of the shaft assembly and other components of FIG. 9(*a*), illustrating one of the cam mechanisms rotated to its non-load-applying position;

FIG. 9(*c*) is a perspective view of the shaft assembly and other components of FIG. 9(*a*), illustrating two of the cam mechanisms rotated to their non-load-applying position;

FIG. 9(*d*) is a perspective view of the shaft assembly and other components of FIG. 9(*a*) illustrating three of the cam mechanisms rotated to their non-load-applying position;

FIG. 11(*b*) is a perspective view of one of the coupling collars of FIG. 11(*a*).

DETAILED DESCRIPTION OF PREFERRED EMBODIMENTS

Figure 1A:
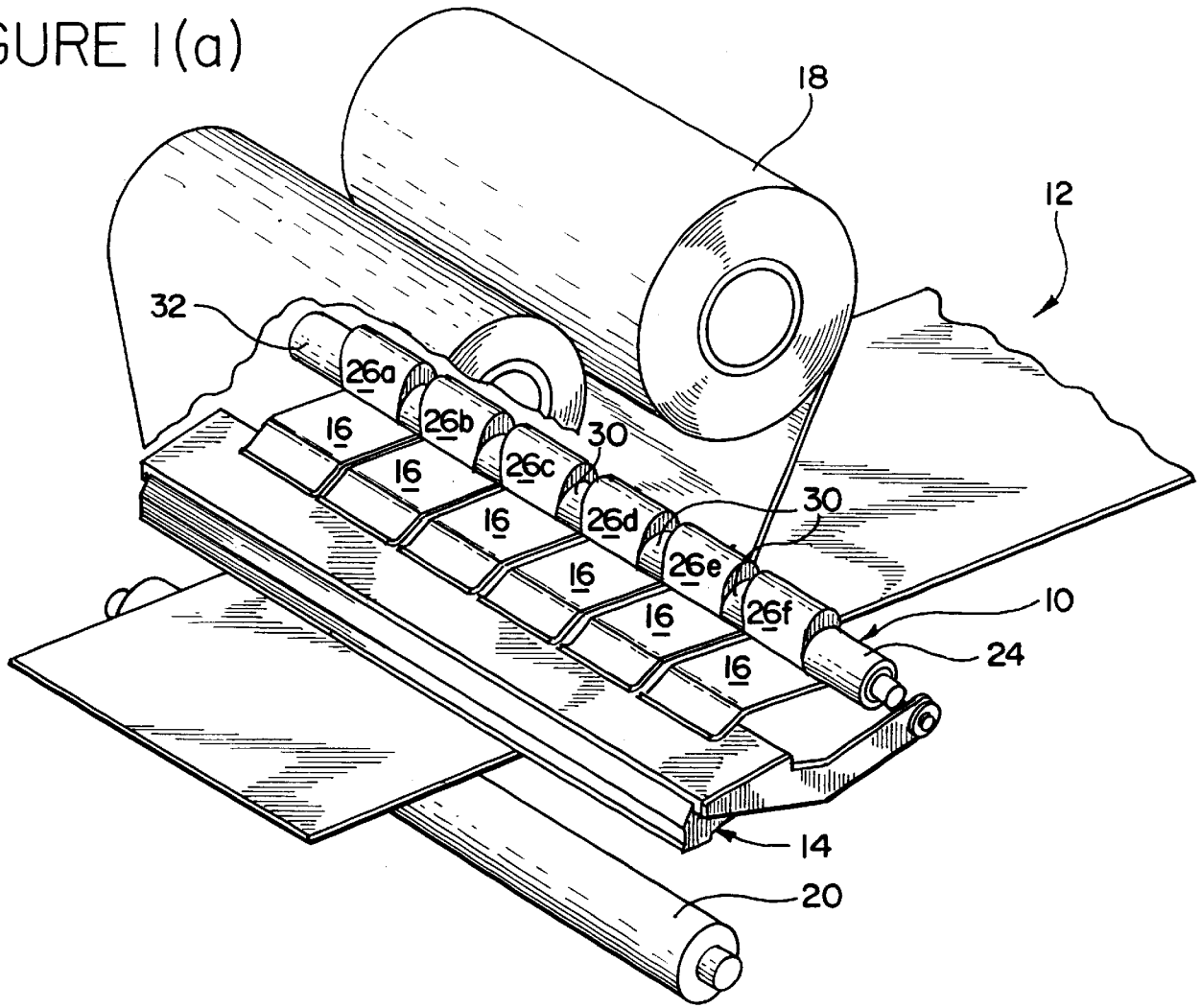
FIG. 1(*a*) is a broken perspective view of a shaft assembly for a thermal printer system in accordance with a preferred embodiment of the invention, illustrating the cam mechanisms of the shaft assembly in an unengaged or non-load-applying position and also illustrating, schematically in nature, other components of a thermal printer system, including the thermal print head, the spool of web material, the platen roll and leaf springs for engaging the thermal print head.
Figure 1:
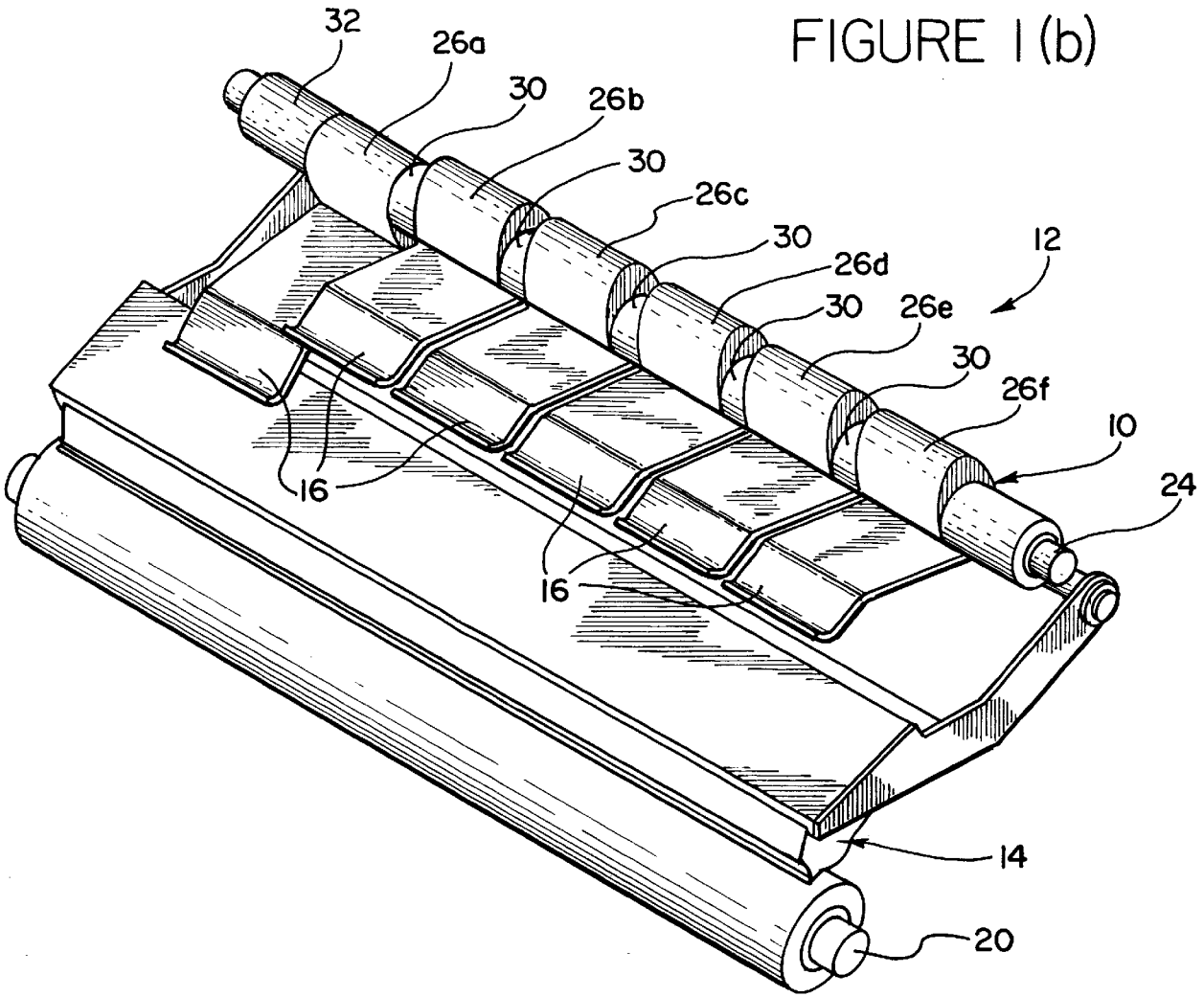
Figure 1C:
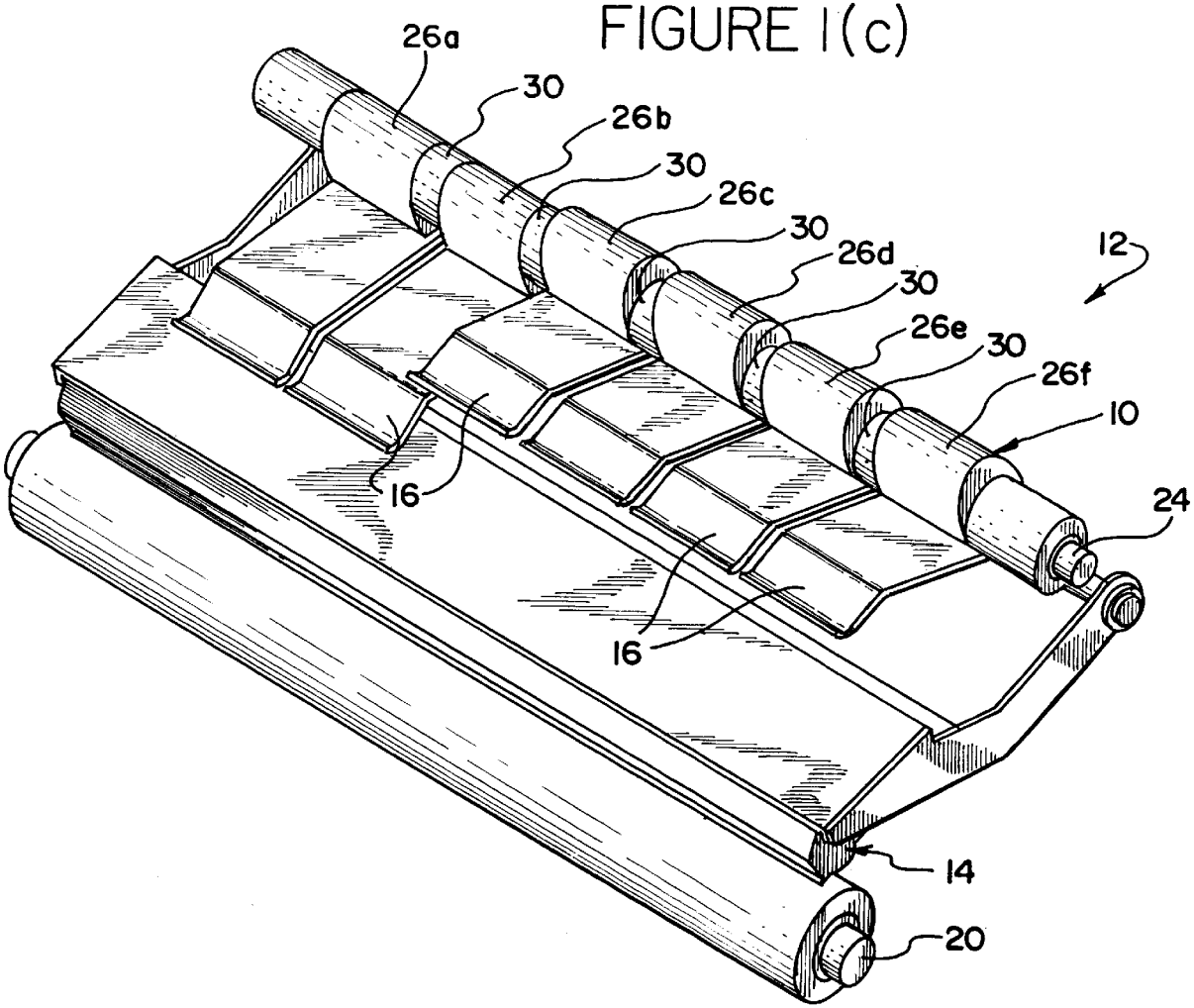
Figure 1D:
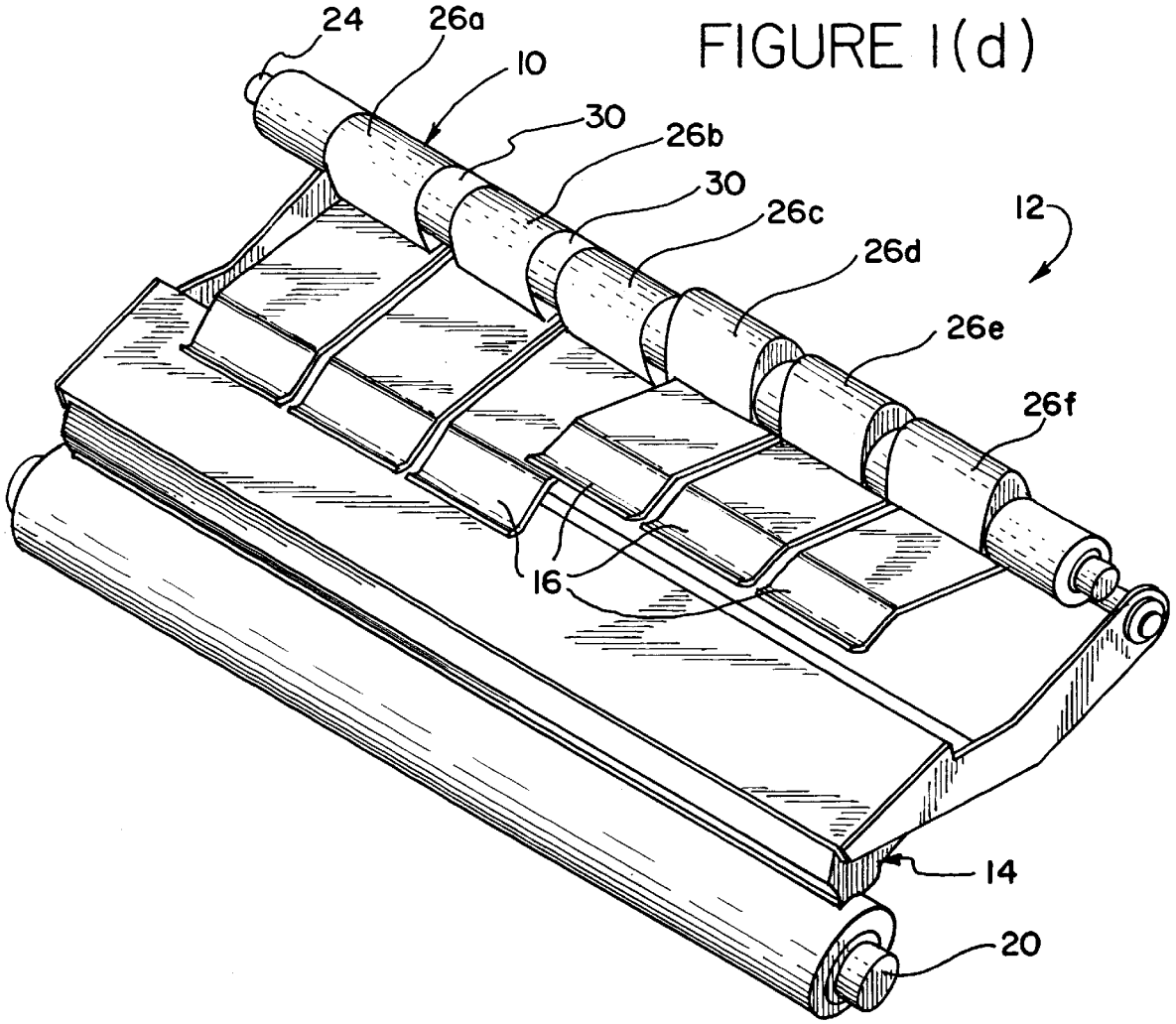
Figure 1E:
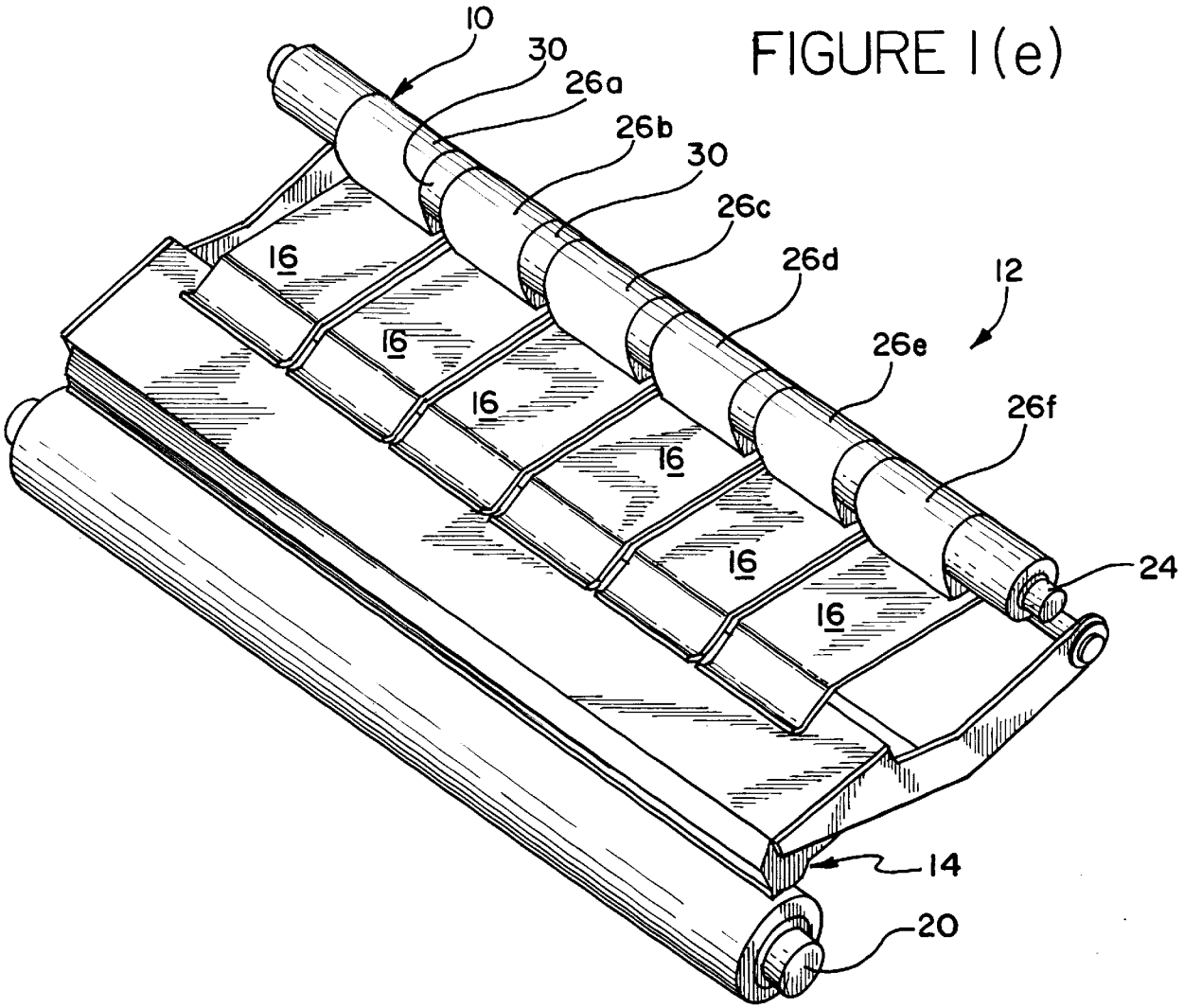
Figure 5:
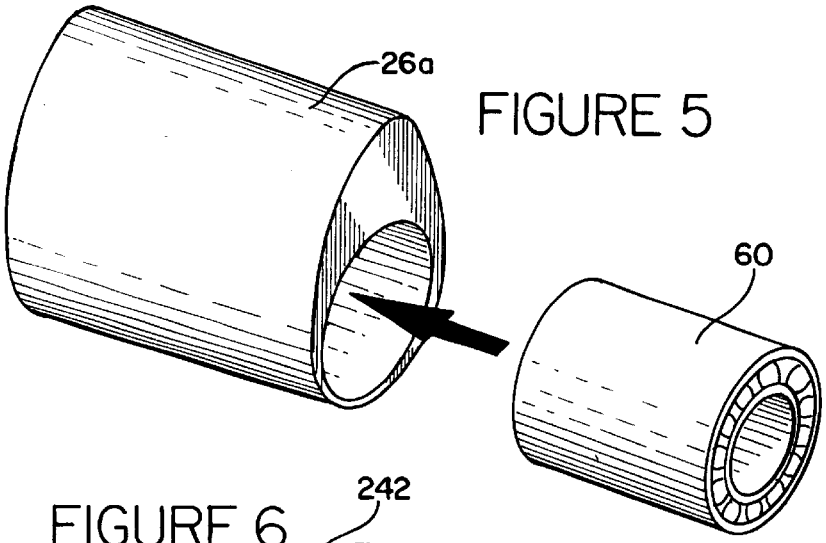
FIG. 5 is a perspective and exploded view illustrating one of the end cam mechanisms in accordance with an alternative embodiment of the invention including a one-way roller clutch mechanism to be housed therein.

FIGS. 1(*a*)–1(*e*) illustrate, schematically in nature, a shaft assembly 10 in accordance with a preferred embodiment of the invention associated with other components of a thermal printer system 12, including, a thermal print head 14, a plurality of leaf springs 16 for applying loads from the shaft assembly to the thermal print head, a spool 18 of web material associated with the thermal print head, and a platen roll 20. In the illustrated embodiment, shaft assembly 10 includes a shaft 24, a plurality of cam mechanisms 26*a*–26*f* positioned in a side-by-side manner, a plurality of coupling collars 30 for coupling together the cam mechanisms, and a drive hub 32 adjacent end cam mechanism 26*a*.

The illustrated shaft assembly 10 is adapted to adjustably apply a predetermined load to thermal print head 14 along the length of the print head to accommodate media of predetermined width. In a preferred embodiment, rotation of shaft 24 a first predetermined degree or increment in a first or loading direction causes end cam mechanism 26*a* to rotate to a load-applying position in which it applies a load to a respective leaf spring 16 (see e.g. FIG. 1(*b*)). Further rotation of shaft 24 a second predetermined degree or increment in the first direction causes end cam mechanism 26*a* to rotate further in the first direction and to engage adjacent cam mechanism 26*b* to cause it to rotate in the first direction to its load-applying position, so that cam mechanisms 26*a* and 26*b* are in their load-applying position (see e.g. FIG. 1(*c*)). Each further incremental rotation of shaft 24 the further second increment in the first direction causes a further cam mechanism 26*c*, 26*d*, 26*e* and 26*f*, respectively, to be rotated to its load-applying position.

Thus, each of cam mechanisms 26*a*–26*f* desirably is adapted to rotate from a non-load applying position to the load-apply position, and from the load applying position to subsequent load-applying positions. In the illustrated embodiment, in their non-load applying position, cam mechanisms 26*a*–26*f* are not engaged with their respective leaf spring 16, but are engaged with their respective leaf spring in any of their load applying third positions, causing respective loads to be applied to thermal print head 14 at respective locations along the thermal print head.

As each of cam mechanisms 26*a*–26*f* is first rotated from its load-applying position to one of its first load-applying positions, it engages an adjacent cam mechanism causing it to rotate from its non-load applying position to its load-applying position and thereby causing the adjacent cam mechanism to apply another respective load to thermal print head 14 at another respective location along the thermal print head. As a result, the load applied to thermal print head 14 can be easily varied by rotating shaft 24 the appropriate number of times in the first direction to rotate the appropriate number of cam mechanisms 26*a*–26*f* to their load-applying positions to engage the appropriate number of leaf springs 16 and thereby apply the desired load distributed along the desired length of thermal print head 14.

By way of example, FIG. 1(*a*) illustrates all of the cam mechanisms 26*a*–26*f* in their non-load-applying position, which, in accordance with this embodiment of the invention, is an unengaged position in which no loads are applied to thermal print head 14. FIG. 1(*b*) illustrates end cam mechanism 26*a* rotated by shaft 24 180° in the first direction from its non-load-applying position to its first load-applying position, which is an engaged position in which left end cam mechanism 26*a* applies a respective load to thermal print head 14 by way of its associated leaf spring 16. FIG. 1(*c*) illustrates end cam mechanism 26*a* further rotated by shaft 24 360° in the first direction from its load-applying position back to its load-applying position, which is in the same engaged position. As this rotation occurs, desirably half way through the rotation, end cam mechanism 26*a* engages adjacent cam mechanism 26*b* causing that cam mechanism to rotate 180° in the first direction from its non-load applying position to its load-applying position. As a result, in FIG. 1(*c*), cam mechanisms 26*a* and 26*b* are applying loads to thermal print head 14. In FIG. 1(*d*), further rotation of shaft 24 360° in the first direction causes cam mechanisms 26*a* and 26*b* to be rotated 360° in the first direction, causing cam mechanisms 26*a* and 26*b* to rotate back to its load-applying position. Cam mechanism 26*b* causes adjacent cam mechanism 26*c* to rotate 180° in the first direction to its load-applying position. In FIG. 1(*d*), cam mechanisms 26*a*, 26*b* and 26*c* are applying loads to thermal print head 14. Each time shaft 24 is further rotated 360°, the next adjacent cam mechanism is rotated to its load-applying position so that this additional cam mechanism applies its respective load to thermal print head 14 to enable the print head to accommodate media of wider width. In FIG. 1(*e*), the shaft has been rotated the appropriate number of times such that all of cam mechanisms 26*a*–26*f* are applying loads to the thermal print head.

Cam mechanisms 26 desirably all have the same cam profile, which may comprise any suitable configuration. In the embodiment of FIGS. 1(*a*)–(*e*), for example, the profile of each cam mechanism is the form of a single lobe cam that includes a minor radius and a major radius (see e.g. FIG. 2). With this embodiment as stated above, the degree of rotation of each cam mechanism 26*a*–26*f* from its non-load applying position to its load-applying position is 180°, and the degree of rotation from its load-applying position back to its load-applying position is 360°.

Figure 7:
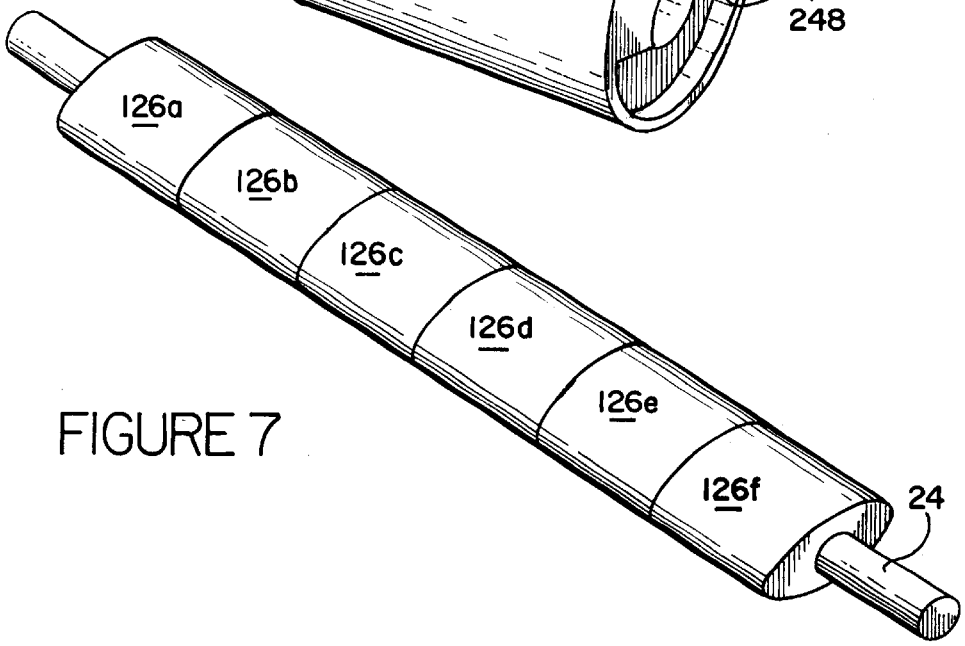
FIG. 7 is a perspective view of a shaft assembly in accordance with a further embodiment of the invention illustrating cam mechanisms having a double lobe profile rotationally coupled directly to each other.
Figure 8A:
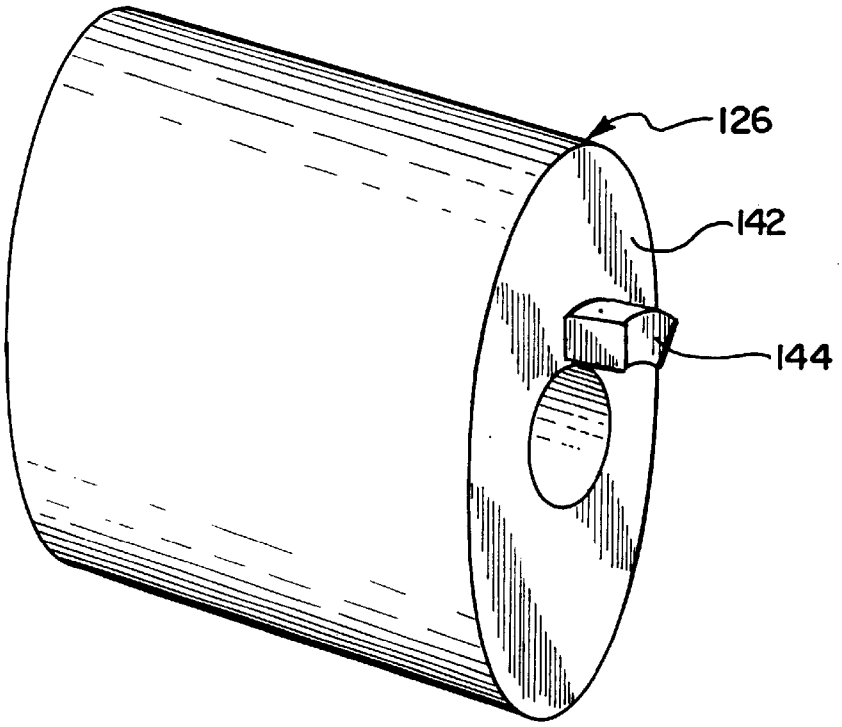
FIG. 8(*a*) is a side view of one of the cam mechanisms of the shaft assembly of FIG. 7.
Figure 8B:
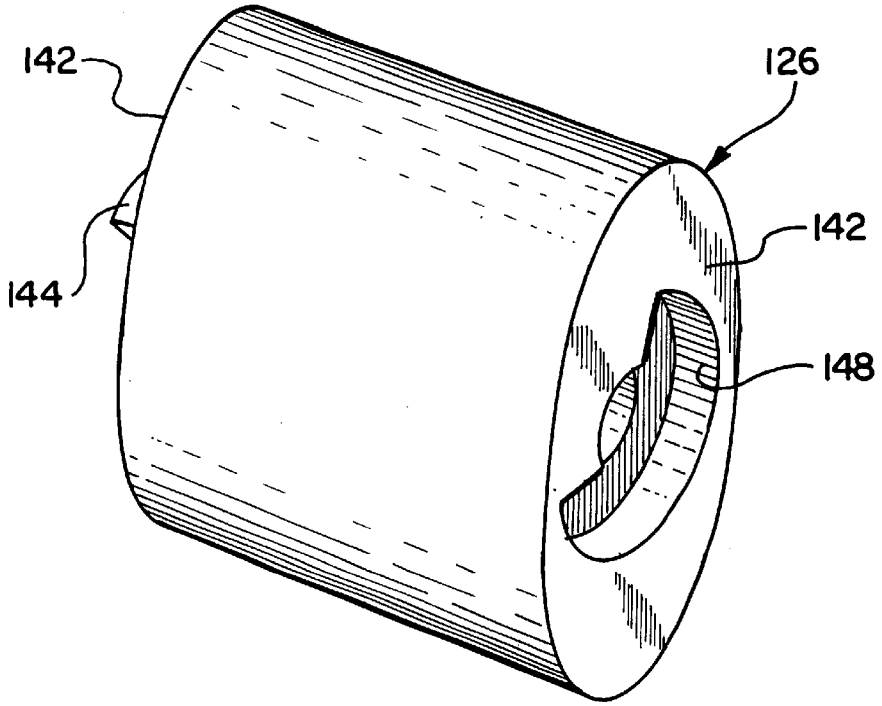
Figure 9A:
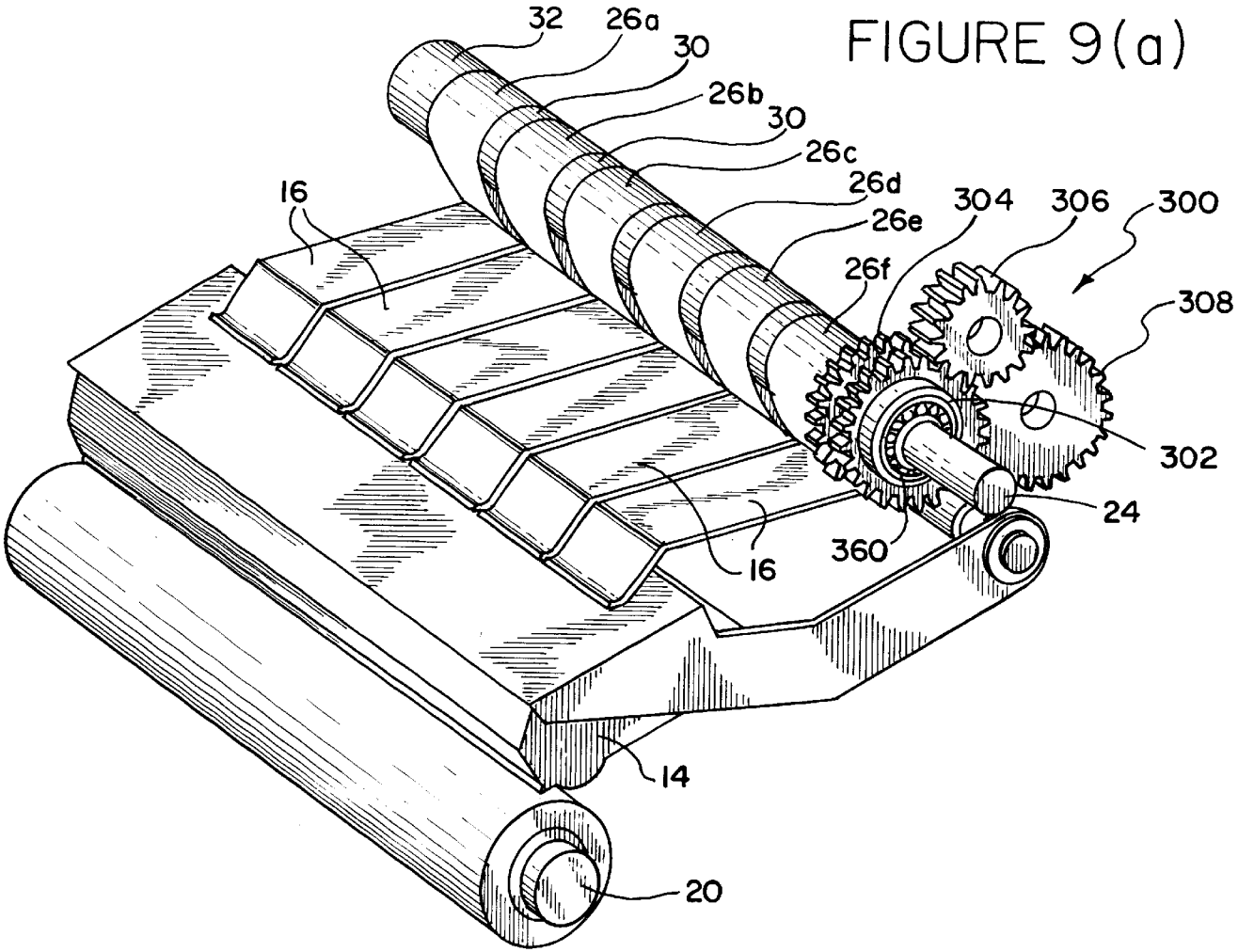
FIG. 9(*a*) is a perspective view of the shaft assembly and other components of FIGS. 1(*a*)–1(*e*), also including a drive assembly for rotating each of the cam mechanisms to their non-load-applying positions.
Figure 9B:
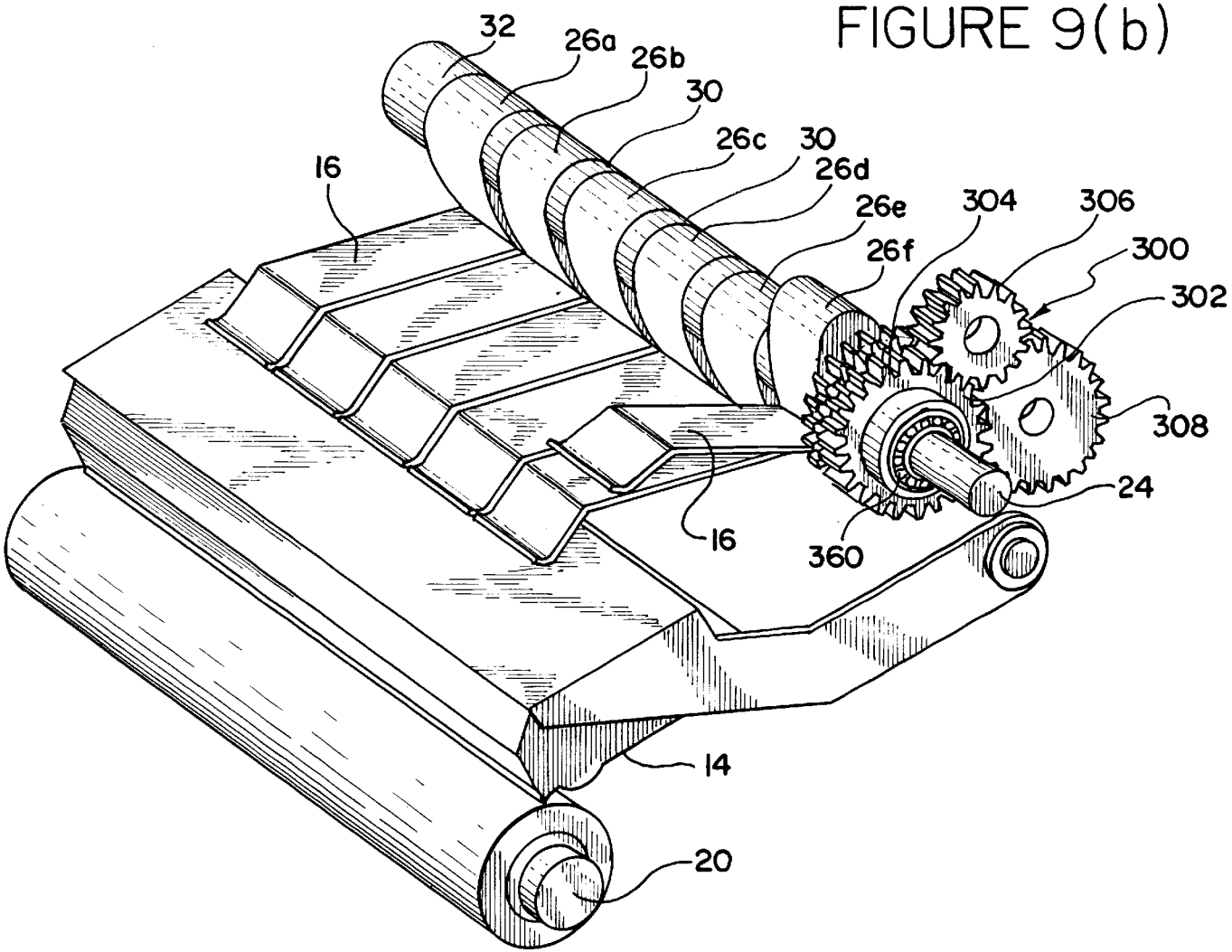
Figure 9C:
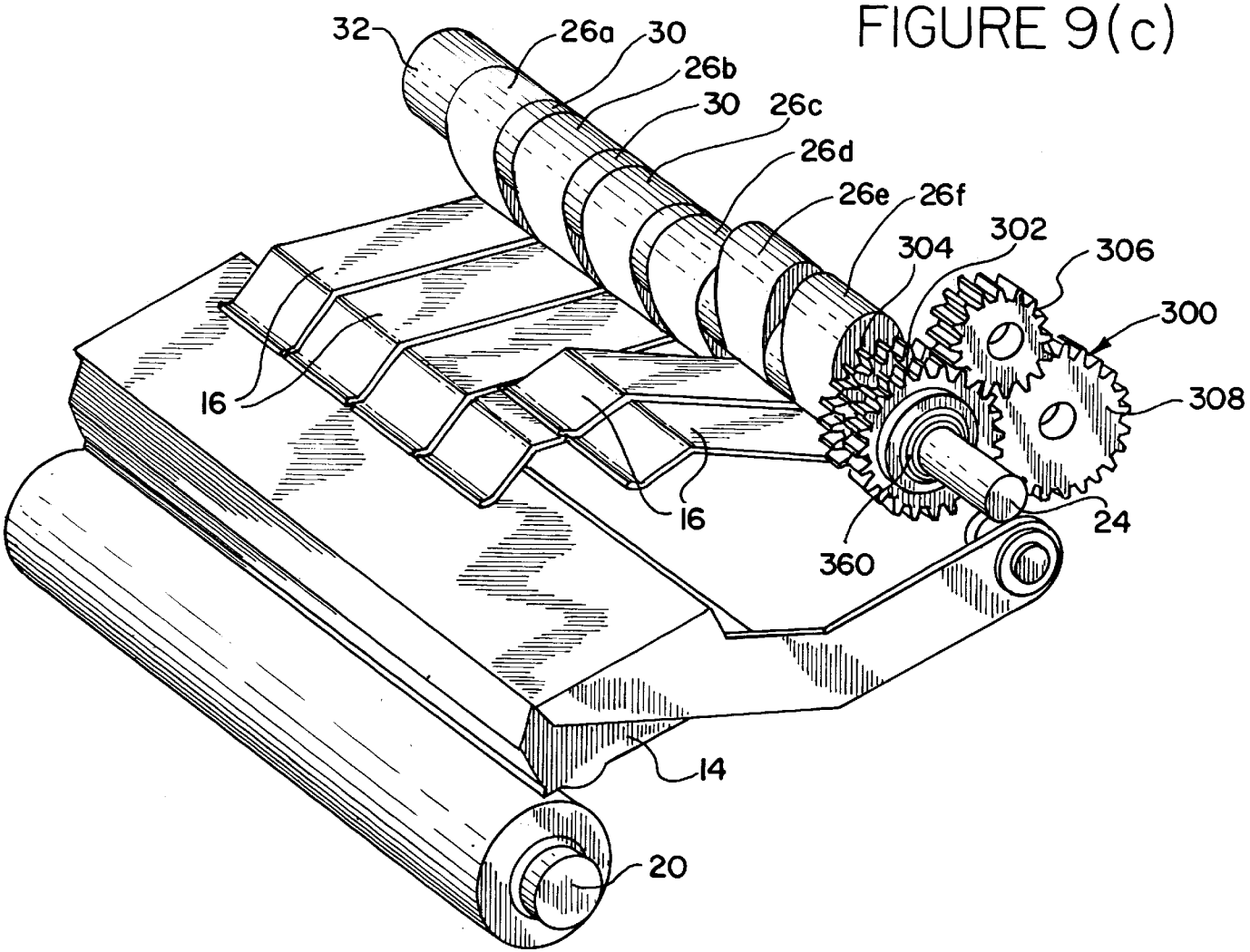
Figure 9D:
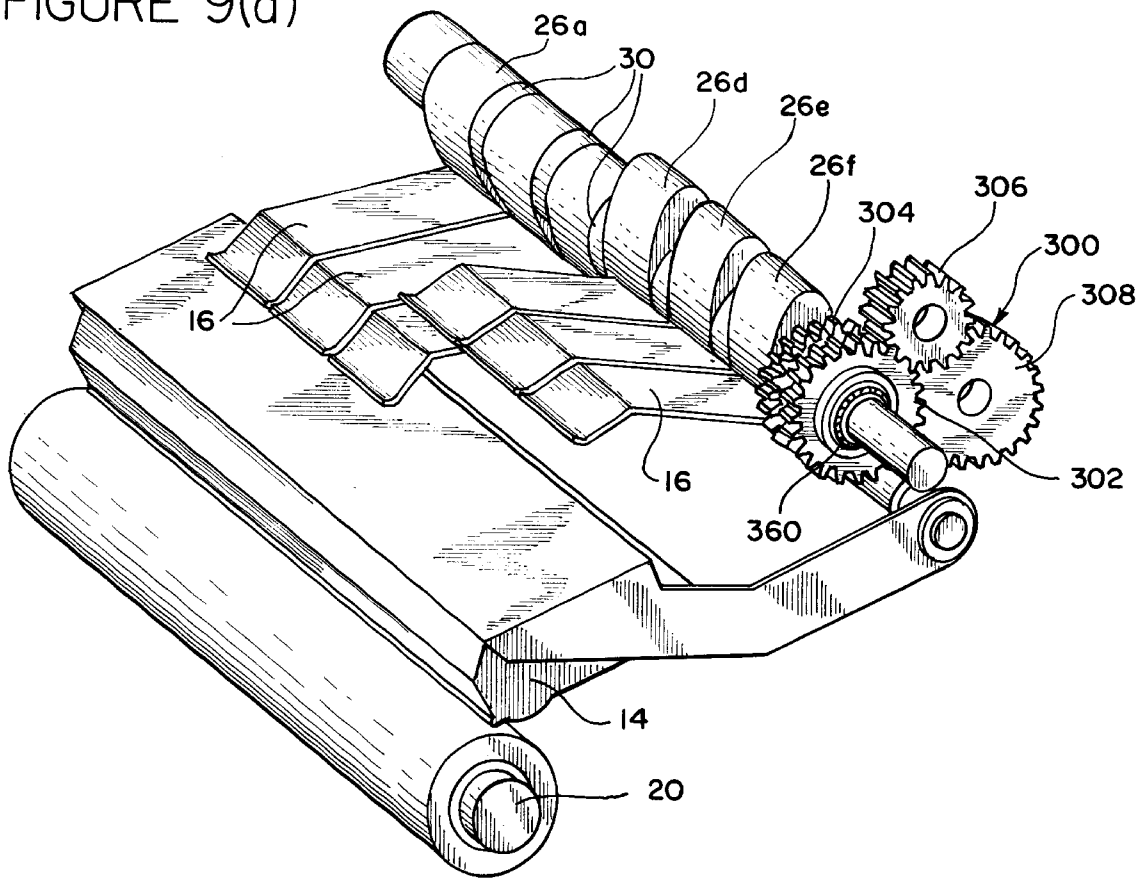

The profile of the cam mechanisms may have different configurations in accordance with alternative embodiments of the invention. FIGS. 7 and 8(*a*)–(*b*), for example, illustrate cam mechanisms 126*a*–126*f* comprising a 180° opposing double lobe profile. With this embodiment, the degree of rotation of each cam mechanism 126*a*–126*f* from its non-load-applying position to its load-applying position is 90° degrees, and the degree of rotation from its load applying position to its load-applying position is 180°.

Cam mechanisms 26 or 126 can be rotationally coupled together in any suitable manner desirably such that each cam mechanism may be rotated to its load-applying position to apply its respective load, may be further rotated back to its load-applying position also to apply its respective load, and, as it rotates back to this position, engages an adjacent cam mechanism to cause the adjacent mechanism to rotate to its load applying position.

In the embodiment of FIGS. 1(*a*)–(*e*), for example, cam mechanisms 26*a*–26*f* are rotationally coupled together by the plurality of coupling collars 30 of the type illustrated in FIGS. 3(*a*) and 3(*b*), with each coupling collar coupling together a respective pair of the cam mechanisms. With this embodiment, each cam mechanism 26*a*–26*f* preferably includes a pair of opposed faces 42 and a nub 44 extending from each opposed face, and coupling collar 30 includes two opposed sides 46 each of which defines a slot 48 for slidably receiving one of the nubs of a respective cam mechanism. Nubs 44 and slots 48 are configured to allow each cam mechanism 26*a*–26*f* to rotate a predetermined degree of rotation relative to its respective coupling collar 30.

Nubs 44 and slots 48 may have any suitable configuration, depending upon the profile of cam mechanisms 26. In the embodiment of FIGS. 1(*a*)–(*e*), nubs 44 and slots 48 have arcuate configurations, each nub having an arc length of 90 degrees and each slot having an arc length of 270 degrees. Each nub 44 desirably includes two engaging surfaces 54 that desirably extend in a radial direction relative to shaft 24, and each slot 48 of coupling collar 30 is defined by a pair of engaging surfaces 56 that desirably extend in a radial direction relative to the shaft for engaging surfaces 54 of the nub to facilitate and limit relative rotation of the cam mechanisms. If desired, the outboard side of end cam mechanisms 26*a* and 26*f* can be constructed different to facilitate engagement with drive hubs or any other structure. In the illustrated embodiment, the drive hub 32 defines an arcuate slot 58 that desirably snugly receives one of the nubs 44 of the end cam mechanism 26*a*.

Figure 6:
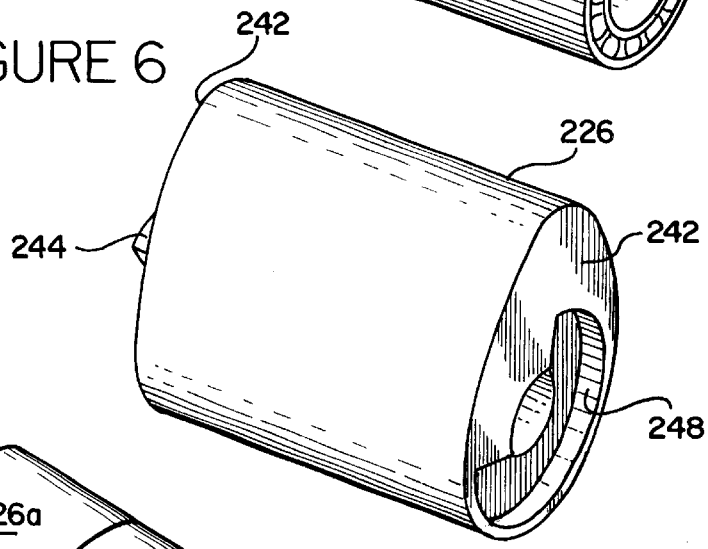
FIG. 6 is a perspective view of a cam mechanism in accordance with an alternative embodiment of the invention.
Figure 11A:
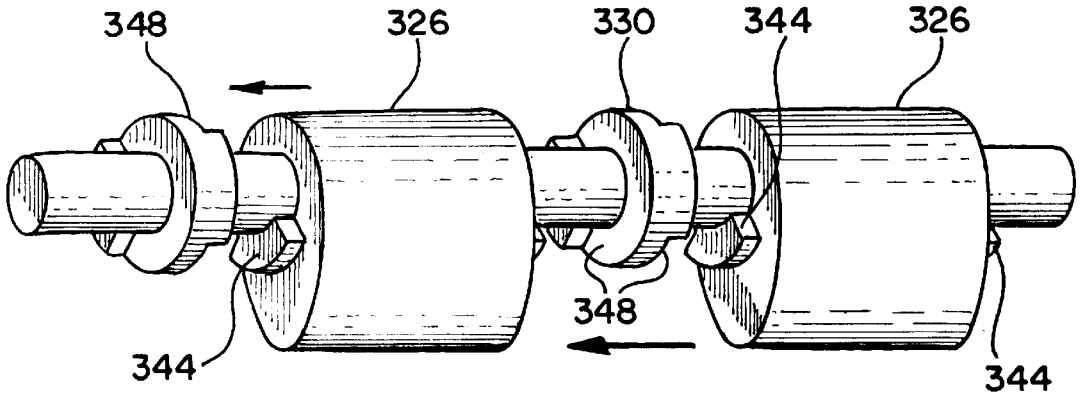
FIG. 11(*a*) is a perspective exploded view, schematic in nature, of cam mechanisms and coupling members rotationally coupling the cam mechanisms together in accordance with an alternative embodiment of the invention.
Figure 11B:
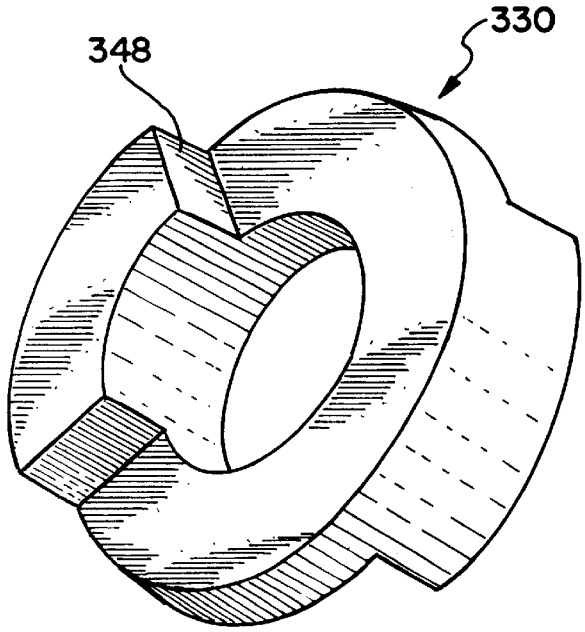

The cam mechanisms and coupling collars can be constructed in any other suitable manners. For example, as illustrated in FIG. 6, the cam mechanisms may each have a nub on one face and define a slot on the other face, and the coupling collars (not shown) can also have a nub on one side and define a slot on the other to facilitate engagement. With this embodiment, each cam mechanism 226 desirably includes an arcuate nub 244 extending from one of its faces 242 and the other face 242 defines an arcuate slot 248. Nub 244 of each cam mechanism 226 is received by a slot of one coupling collar, and slot 248 of each cam mechanism receives a nub of an other coupling collar. If, as in the embodiment of FIGS. 6, cam mechanisms 226 comprise a single lob profile, the nubs 244 and slots 248 desirably have the same construction and configurations as the nubs and slots described above in connection with FIGS. 2 and 3. In accordance with a further alternative embodiment, FIGS. 11(*a*)–(*b*) instead illustrate coupling collars 330 that define slots 348 in the form of recesses to receive mating nubs 344 on the cam mechanisms 326.

In accordance with further alternative embodiments, the cam mechanisms can be coupled directly with each other, as illustrated in FIGS. 7 AND 8(*a*)–(*b*). With this embodiment, wherein cam mechanisms 126 have an opposed double lobe profile, nubs 144 are illustrated as having an arc length of about 45° and slots 148 are illustrated as having an arcuate length of about 225°. Each nub 144 is received by a slot 148 of an adjacent cam mechanism.

Desirably, the end cam mechanism 26*a* is rotated in response to rotation of the shaft. The desired rotation of shaft 24 can be effected manually or in any suitable manner, such as, for example, any suitable electronic or mechanical manner. In the embodiment of FIGS. 1(*a*)–(*e*), for example, shaft 24 assembly includes drive hub 32 for engaging the end cam mechanism 26*a* in response to the manual rotation of the shaft. Drive hub 32 preferably houses a one way roller clutch bearing 60 engaged with shaft 24 to permit one way rotation of the drive hub relative to the shaft. In accordance with alternative embodiments, the roller clutch bearing 60 may instead be disposed within end cam mechanisms 26*a* for facilitating rotation by shaft 24. With this embodiment, end cam mechanism 26(*a*) desirably does not define a slot 48, but each of cam mechanisms 26(*b*)(*c*)(*d*) and (*e*) each define a respective slot. The one way roller clutch bearing 60 may, for example, be the Drawn Cup Needle Roller Bearing or the Drawn Cup Needle Roller Clutch manufactured by The Torrington Company of Torrington, Conn.

Cam mechanisms 26*a*–26*f* can be positioned in any suitable manner relative to the thermal print head to adjustably apply the desired load to structure associated with thermal print head 14, including, for example, leaf springs 16 or even the thermal print head itself. With the embodiment of FIGS. 1(*a*)–(*e*), leaf springs 16 are configured such that they apply respective loads to the thermal print head when engaged by the respective cam mechanism 26. Leaf springs 16 may instead have any other suitable embodiment, however, and may, for example, be configured or oriented such that application of loads to the leaf springs does not result in application of the load to the thermal printhead; thus, the respective load might actually be applied to the thermal printhead when the cam mechanism is in its non-load-applying position. Moreover, any other suitable structure associated with thermal print head 14 may instead be used in accordance with alternative embodiments, including, the thermal print head 14 itself.

Figure 10:
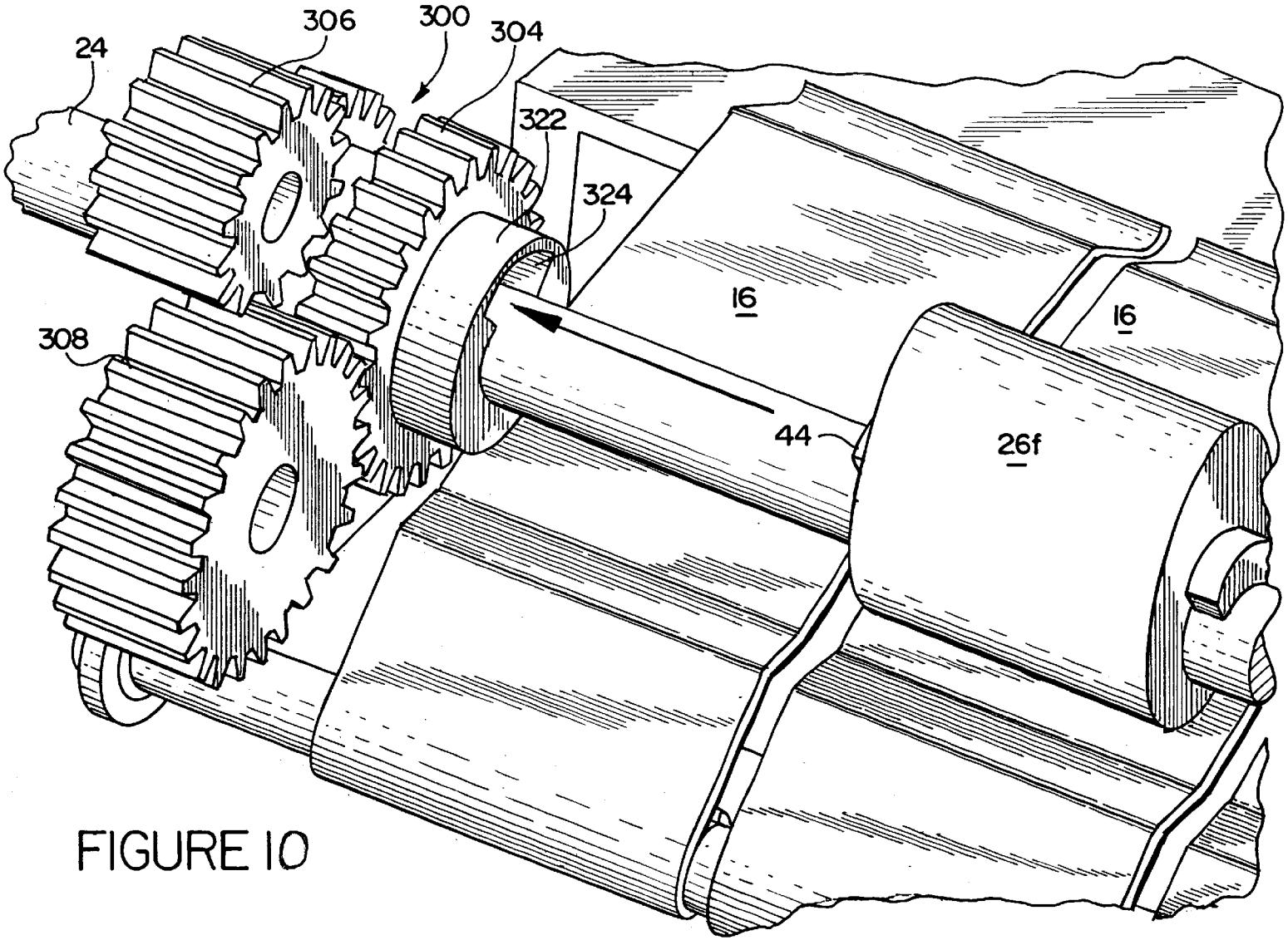
FIG. 10 is a partial view of the drive assembly of FIGS. 9(*a*)–9(*d*) taken from a reverse angle, illustrating with an arrow the manner in which an end cam mechanism may be engaged with the gear assembly.

Shaft assembly 10 desirably also includes any suitable structure for rotating cam mechanisms 26*a*–26*f* back to the unloading position. In a preferred embodiment (see FIGS. 9(*a*)–(*d*)), for example, a drive assembly 300 may be included for rotating cam mechanisms 26*a*–26*f* back to their unloading position one-by-one from end cam mechanism 26*f* to end cam mechanism 26*a* as the shaft is rotated in a second or unloading direction. The illustrated drive assembly 300 may include a gear clutch 302 and an unloading drive hub gear 304 disposed about shaft 24, and a pair of idler gears 306 and 308 (see FIG. 10). Gear clutch 302 includes or is otherwise associated with a one-way roller clutch bearing 360 oriented such that the gear clutch rotates with the shaft when the shaft rotates in the second direction. Unloading drive hub gear 304 is rotationally coupled to end cam mechanism 26*f*, and clutch gear 302 by way of idler gears 306 and 308 causing the unloading drivehub gear to rotate in the first direction when the shaft rotates in the second direction. In the illustrated embodiment, idler gear 306 meshes with both gear clutch 302 and idler gear 308, and idler gear 308 meshes with unloading drive hub gear 304 to cause the unloading drive hub gear to rotate in the first direction when shaft 24 rotates in the second direction. Although unloading drive hub gear 304 may be rotationally coupled to end cam mechanism 26*f* in any suitable manner, in the illustrated embodiment, unloading drive hub gear 304 includes an unloading drive hub that may be in the form of a drive extension 322 that defines an arcuate slot 324 to receive desirably by snug fit arcuate nub 44 or similar structure of cam mechanism 26*f*. The one way roller clutch bearing 360 may be of the same type as one way roller clutch bearing 60, but preferably is oriented in an opposite rotational direction to bearing 60.

The foregoing description is for purposes of illustration only and is not intended to limit the scope of protection accorded this invention. The scope of protection is to be measured by the following claims, which should be interpreted as broadly as the inventive contribution permits.

What is claimed is:

1. A shaft assembly for a thermal printer system for adjustably applying loads along the length of a thermal print head of the thermal printer system, the shaft assembly including:

(a) a shaft; and (b) a plurality of cam mechanisms rotatably mounted on the shaft and adapted to apply respective loads to the thermal print head at respective locations along the length of the thermal print head, each cam mechanism being rotationally coupled with an adjacent cam mechanism, each cam mechanism rotatable from a non-load-applying position to a load-applying position and from the load-applying position to subsequent load-applying positions, each cam mechanism adapted to apply a respective load to structure associated with the thermal print head at a respective location of the structure when the cam mechanism is in its load-applying position and when the cam mechanism is in any of its subsequent load-applying positions, each cam mechanism rotationally engaging the adjacent cam mechanism to cause the adjacent cam mechanism to rotate from the non-load-applying position of the adjacent cam mechanism to the load-applying position of the adjacent cam mechanism as the cam mechanism rotates from the load-applying position to a first subsequent load-applying position.

2. The shaft assembly of claim 1 wherein the degree of rotation of each cam mechanism from its non-load applying position to its load-applying position is 180° and the degree of rotation of each cam mechanism from its load-applying position to subsequent load-applying positions is a multiple of 360°.

3. The shaft assembly of claim 2 wherein each cam mechanism has a single lobe profile.

4. The shaft assembly of claim 1 wherein the degree of rotation of each cam mechanism from its non-load applying position to its load-applying position is 90° and the degree of rotation of each cam mechanism from its load-applying position to subsequent load-applying positions is a multiple of 180°.

5. The shaft assembly of claim 4 wherein each cam mechanism has a double lobe profile.

6. The shaft assembly of claim 1 further comprising a plurality of coupling members rotatably coupling the cam mechanisms together.

7. The shaft assembly of claim 6 wherein each cam mechanism has a pair of end faces and a nub on each end face, and wherein each coupling member defines two slots, each slot for slidably receiving one of the nubs of a respective cam mechanism to permit limited rotation of the respective cam mechanism relative to the coupling member.

8. The shaft assembly of claim 7 wherein each coupling member has two sides, each side defining a respective one of the slots.

9. The shaft assembly of claim 8 wherein the nubs and slots are arcuate.

10. The shaft assembly of claim 9 wherein the arc length of each nub is 90°, and the arc length of each slot is 270°.

11. The shaft assembly of claim 7 wherein each nub includes two substantially planar first surfaces oriented in a radial direction relative to the shaft, and each slot is defined by two substantially planar second surfaces of the coupling member oriented in a radial direction relative to the shaft, each substantially planar second surface adapted to abuttingly engage one of the substantially planar first surfaces of the respective cam mechanism to limit rotation of the respective cam mechanism relative to the coupling member.

12. The shaft assembly of claim 1 wherein at least some of the cam mechanisms have two end faces, one end face including an arcuate nub and the other end face defining an arcuate slot, the arcuate nub of the cam mechanism adapted to be slidably received within the arcuate slot of the adjacent cam mechanism and the arcuate slot of the cam mechanism adapted to slidably receive the nub of an other adjacent cam mechanism.

13. The shaft assembly of claim 12 wherein each cam mechanism has a single lobe profile, and the degree of rotation of each cam mechanism from its non-load-applying position to its load-applying position is 180° and the degree of rotation of each cam mechanism from its load-applying position to subsequent load-applying positions is a multiple of 360°.

14. The shaft assembly of claim 12 wherein each cam mechanism has a double lobe profile, and the degree of rotation of each cam mechanism from its non-load-applying position to its load-applying position is 90° and the degree of rotation of each cam mechanism from its load-applying position to subsequent load-applying positions is a multiple of 180°.

15. The shaft assembly of claim 1 wherein the plurality of cam mechanisms includes a pair of end cam mechanisms, the shaft assembly further comprising a drive hub mounted on the shaft adjacent one of the end cam mechanisms for rotating the shaft to cause rotation of said one end cam mechanism.

16. The shaft assembly of claim 15 further including a one way roller clutch bearing associated with the drive hub.

17. The shaft assembly of claim 1 wherein the plurality of cam mechanisms includes a pair of end cam mechanisms, the shaft assembly including a one way roller clutch bearing associated with one of the end cam mechanisms.

18. The shaft assembly of claim 1 wherein the cam mechanisms are mounted along the shaft in a side-by-side manner.

19. The shaft assembly of claim 1 further including a plurality of coupling members rotationally coupling pairs of cam mechanisms together, each coupling member being disposed between a respective pair of cam mechanisms.

20. The shaft assembly of claim 1 wherein rotation of the shaft in a first direction is adapted to cause rotation of the cam mechanisms.

21. A shaft assembly for a thermal printer system for adjustably applying loads along the length of a thermal print head of the thermal printer system, the shaft assembly including:

(a) a shaft; and (b) a plurality of cam mechanisms rotatably mounted on the shaft and adapted to apply respective loads to the thermal print head, each cam mechanism being rotationally coupled with an adjacent cam mechanism, each cam mechanism rotatable in a first direction from a non-load-applying position to a load-applying position and from the load-applying position to subsequent load-applying positions, the plurality of cam mechanisms including a pair of end cam mechanisms, wherein rotation of the shaft a first increment in the first direction causes one of the end cam mechanisms to rotate from its non-load-applying position to its load-applying position and subsequent rotation of the shaft a second increment in the first direction causes said one end cam mechanism to rotate to a first of its subsequent load-applying positions and causes a cam mechanism adjacent to said one end cam mechanism to rotate to its load-applying position, and each subsequent rotation of the shaft a third increment in the first direction causes the rotated cam mechanisms to rotate to a respective one of their subsequent load-applying positions and causes an additional cam mechanism to rotate to its load-applying position until the other end cam mechanism is rotated to its load-applying position.

22. The shaft assembly of claim 21 wherein the first increment is 180°, the second increment is 360°, and the third increment is 360°.

23. The shaft assembly of claim 21 wherein the first increment is 90°, the second increment is 180°, and the third increment is 180°.

24. The shaft assembly of claim 21 further including a drive assembly for rotating each of the cam mechanisms to its non-load-applying position in response to rotation of the shaft in a second direction.

25. The shaft assembly of claim 24 wherein the drive assembly includes a drive hub disposed about the shaft and rotationally coupled with the other end cam mechanism, the drive hub adapted to rotate in the first direction when the shaft is rotated in the second direction.

26. The shaft assembly of claim 25 wherein the drive assembly is adapted to rotate the cam mechanisms to their non-load applying position and to subsequent non-load-applying positions, wherein rotation of the shaft the first increment in the second direction causes the other end cam mechanism to rotate in the first direction to its non-load-applying position and subsequent rotation of the shaft the second increment in the second direction causes said one end cam mechanism to rotate in the first direction to one of its subsequent load-applying positions and causes a cam mechanism adjacent to said one end cam mechanism to rotate in the first direction to its non-load-applying position, and subsequent rotations of the shaft the third increment in the second direction causes another of the cam mechanisms to rotate in the first direction to its non-load-applying position until the one end cam mechanism is rotated in the first direction to its non-load-applying position.

27. The shaft assembly of claim 26 wherein the roller assembly includes a gear assembly for rotating the drive hub in the first direction when the shaft rotates in the second direction.

28. The shaft assembly of claim 27 wherein the roller assembly includes a gear clutch disposed about the shaft, a first idler gear, a second idler gear and a drive hub gear associated with the drive hub, the first idler gear being in engagement with the gear clutch and the second idler gear, and the second idler gear being in engagement with the drive hub gear.

29. The shaft assembly of claim 26 wherein the first increment is 180°, the second increment is 360°, and the third increment is 360°.

30. The shaft assembly of claim 26 wherein the first increment is 90°, the second increment is 180°, and the third increment is 180°.

* * * * *